United States Patent [19]

Orr, Jr. et al.

[11] Patent Number: 4,723,925

[45] Date of Patent: Feb. 9, 1988

[54] CRIMP CONTACT FOR A PRINTED CIRCUIT BOARD AND METHOD

[75] Inventors: Lawrence W. Orr, Jr.; Ray T. Motte, Jr., Both of Simpsonville, S.C.

[73] Assignee: Woven Electronics Corporation, Mauldin, S.C.

[21] Appl. No.: 20,398

[22] Filed: Mar. 2, 1987

[51] Int. Cl.[4] ..... H01R 4/10

[52] U.S. Cl. ..... 439/877; 29/867; 439/83

[58] Field of Search ..... 29/867; 439/83, 879, 439/876–878

[56] References Cited

U.S. PATENT DOCUMENTS 4,236,776 12/1980 Wellington ..... 439/83

4,509,808 4/1985 Hellgren ..... 439/83

*Primary Examiner*—Eugene F. Desmond

*Attorney, Agent, or Firm*—Cort Flint

[57] ABSTRACT

A crimp contact and method for terminating discrete electrical conductor wires with a printed circuit board includes a crimp contact A having a crimp barrel (10) in which wire (16) is crimped. A solder post (24) extends from a widened circular flange (22) which is integral with the crimp barrel. Spacer block (20) spaces circular flange (22) above plated through hole (32) so that a space is provided which may be completely filled with solder. A pair of quarter round seating sections (28 and 30) are formed on opposing surfaces (**24*a* and 24*c*) of solder post (24). The remaining periphery of solder post is open at (42**) to facilitate upward and complete flow of the solder.

12 Claims, 5 Drawing Figures

CRIMP CONTACT FOR A PRINTED CIRCUIT BOARD AND METHOD

BACKGROUND OF THE INVENTION

The invention relates to the termination of insulated electrical conductor wires to a printed circuit board, and more particularly to the provision of a crimp contact and method for terminating the printed circuit board.

A printed circuit board may consist of multiple layers of electrical circuitry built up on one another. Plated-through holes are formed in the printed circuit board to interconnect the various levels of electrical circuitry. Insulated electrical wires are terminated in the plated-through hole to make electrical connection with the printed circuit board.

Normally, the conductor wires have been terminated by stripping the insulation from the ends of the wire, inserting the bare wire strand into the plated-through hole and soldering the wire in the hole. This involves a large number of plated-through holes and a large number of individual wires which must be stripped and soldered individually in the hole.

The quality standards for terminated printed circuit board in the military and commercial markets are extremely high. It is very difficult to solder a discrete wire to a printed circuit board without a number of problems occurring. First, there must be a proper insulation gap between the wire and the board. The tinining of the wire strand in preparation for soldering is also very difficult and time consuming. Each step has to be inspected. Bird caging is also a problem when manipulating the wire strand after tinining into the hole of the printed circuit board. The wire and the strands may separate resulting in a bird nest appearance. As soon as the wire strands separate, it is a cause for rejection. Once the discrete wire is properly inserted in the plated-through hole, the soldering process is very time consuming and tedious. The process requires two technicians. One technician solders while the other operator holds the wire at the plated-through hole with the proper insulation gap. The technician then solders the wire in the hole from the opposite side. This process is very slow for mass production of printed circuit boards having a large number of plated through holes.

Often it is necessary to repair the terminated wiring at the printed circuit board. When this is done in the field, the repair process can be tedious. Hundreds of wires may be terminated at the printed circuit board with only a spacing of a few mils between the plated-through holes. In the repair process, great care must be taken not to damage adjacent wiring. In repairing the broken wire, there is a good chance that some wire length will be lost. Normally, there is not additional wire length present in order to reprocess the wire. If the wire is soldered in the plated-through hole, it is very difficult to get all of the strands out of the board without damaging the board itself. In the field, only a limited amount of tooling is available to repair the broken wire. Often the board may have to be removed and repaired in a shop.

It can be seen that the termination and repair of discrete wires at a printed circuit board involves problems to which considerable attention need to be given.

Socket contacts have been used in the electronic interconnection industry for some time in various configurations. Some of the contacts are force-fitted directly into holes in the panel or printed circuit board.

Other contacts are intended to be directly inserted in through plated-through holes in similar panel or printed circuit boards. The considerations involved with each type of mounting are normally somewhat different. For example, U.S. Pat. No. 4,236,776 discloses an electrical socket contact having an open socket and a solder tail. The solder tail may be disposed in the opening of a plated-through hole. Ribs are formed on conical bottom surface of the socket which provides an opening between the top rim of the plated-through hole and the bottom surface of the socket contact. This facilitates flow of the solder between the space of the solder tail and the hole plating and between the hole plating and the socket contact. In the socket contact type of connector, a pin connector is normally utilized having pins which mate with the socket opening for termination. Thus, this type of connector is not suitable for terminating discrete wires through the plated holes of a printed circuit board. U.S. Pat. No. 4,080,037 likewise discloses a receptacle terminal for a printed circuit board. The terminal receptacles are placed in the holes of the printed circuit board and soldered. A pin type connector is then terminated to the board by inserting the prongs of the connector into the terminal receptacles.

U.S. Pat. No. 4,548,540 discloses an arrangement for connecting a terminal pin to a printed circuit board conductor by means of an electrically conductive elastomeric collar positioned about the terminal end and pressed into a plated-through hole in the printed circuit board. The terminal pin is then wire wrapped to terminate the individual wire to the printed circuit board. While all of the above disclosed termination arrangements which may be satisfactory for the intended application, none are entirely satisfactory for terminating and repairing a large number of discrete wires at a printed circuit board.

Accordingly, an important object is to provide a connector and method for terminating and repairing discrete wiring at a printed circuit board.

Another object of the invention is to provide a method for terminating and repairing printed circuit boards which uses a unique crimp contact.

Another object of the invention is to provide a crimp contact for terminating a printed circuit board wherein a discrete wire may be crimped and the contact then firmly seated in a plated-through hole in a printed circuit board for reliable and positive electrical connection between the plating and the crimp contact.

Another object of the invention is to provide a crimp contact and method for terminating a printed circuit board wherein the crimp contact is supported above the plating or the hole in which it is seated with adequate clearance between the solder post and bottom of the contact so that a complete and even distribution of solder occurs.

Another object of the invention is to provide a crimp contact for terminating a printed circuit board and method wherein the contact may be crimped to a wire and seated in the plated-through hole of the printed circuit board in a manner that the flow of solder is complete upwardly along the solder post of the contact to the top and between the plating and contact.

Another object of the invention is to provide a method of terminating a printed circuit board wherein large numbers of discrete wires may be prepared and crimped into individual crimp contacts which are inserted and seated firmly in a plated-through hole of the printed circuit board wherein the contacts may be firmly seated in the plated-through holes and soldered in large numbers for mass production.

Still another object of the invention is to provide a crimp contact and method for repairing a printed circuit board wherein the crimped contact may be easily removed from the printed circuit board for repairing broken wiring.

SUMMARY OF THE INVENTION

A crimp contact for terminating discrete, electrical conductors to a printed circuit board having plated-through holes comprising an elongated crimp barrel having a hollow interior for receiving and crimping an electrical conductor to hold the conductor firmly in electrical contact, a widened flange surrounding the crimp barrel extending radially outward beyond the crimp barrel providing an enlarged solder contact surface on a lower surface thereof facing the printed circuit board when inserted in the board, a spacer block integral with the widened flange and disposed below the widened flange for supporting the widened flange above the printed circuit board to create a solder space between the enlarged solder contact surface and the plated-through hole, a generally square solder post extending from the solder contact surface and the spacer block terminating at a free end, a pair of round sections carried by opposing planar surfaces of the square solder posts for engaging an inside diameter of the plated-through hole and firmly seating the contact within the plated-through hole in a manner that movement in a radial direction is prevented and movement in an axial direction is limited so that the contact is held firmly in the plated-through hole for soldering, and the solder post having two opposing planar surfaces which are devoid of round seating sections so that the planar post surfaces extend from the free end of the solder post to the annular contact surface facilitating the flow of solder along generally the entire length of the solder post through the plated through hole and outwardly through the solder space for complete soldering against the enlarged solder contact surface.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
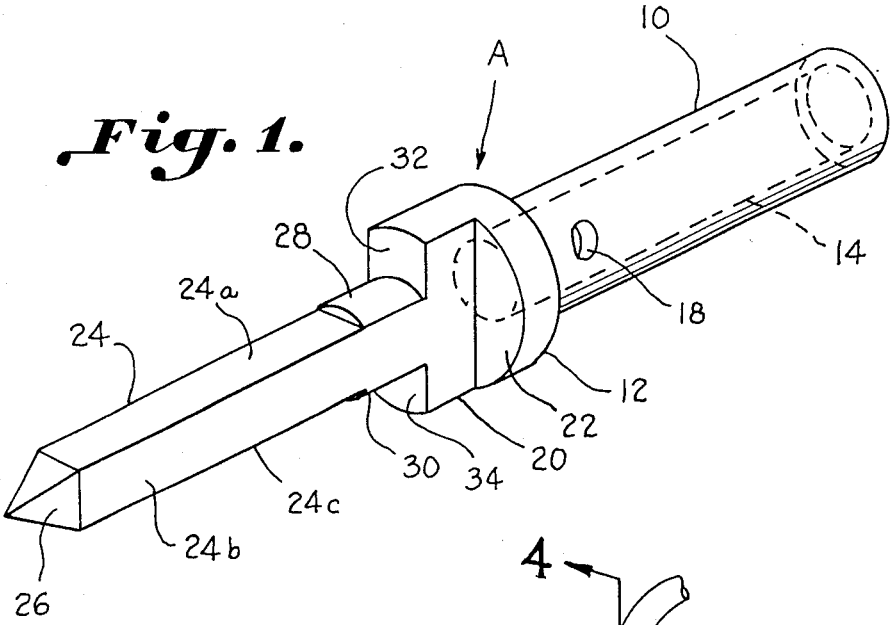
FIG. 1 is a perspective view of a crimp contact for terminating a printed circuit board constructed in accordance with the present invention.
Figure 2:
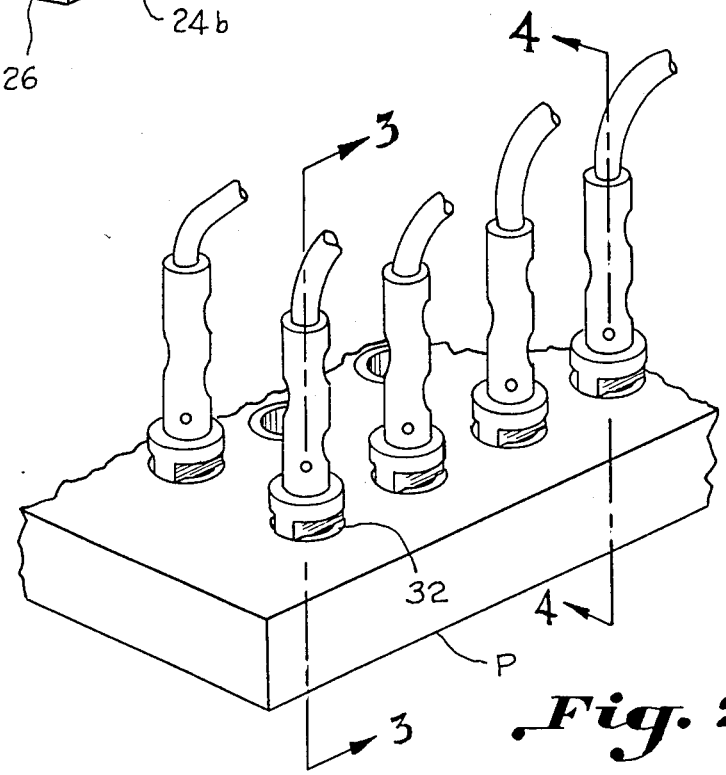
FIG. 2 is a perspective view of a multilayer printed circuit board terminated by using crimp contacts and the method of the present invention.

Referring now in more detail to the drawings, a crimp contact, designated generally as A, is illustrated in FIG. 1 which includes a crimp barrel that terminates at a widened circular flange 12. The interior 14 of crimp barrel 10 is hollow for receiving the wire strands 16 of an insulated conductor wire, as can best be seen in FIG. 3. A detection hole 18 is formed in the crimp barrel to detect the presence of wire strands for proper crimping. A spacer means in the form of a rectangular block 20 is formed below the circular flange 14. A lower solder contact surface 22 is defined on opposing sides of rectangular block 20, the purpose of which will be explained more fully below. A square solder post 24 extends from spacer block 20, or actually extends from solder contact surface 22, and terminates at a free end 26. Free end 26 is tapered to a substantial point. Two opposing surfaces **24*a* and 24*c* of square post 24 have formed thereon around sections 28 and 30, respectively, in the form of a quarter round section. These quarter round sections provide seating means for seating the square post in a plated-through hole 32 of printed circuit board P as can best be seen in FIGS. 3 and 4. It can be seen that remaining planar surfaces 24*b* and 24*d* of square solder post 24 extend from free end 26 to the lower solder contact surface 22** on opposing sides of the square post.

Figure 3:
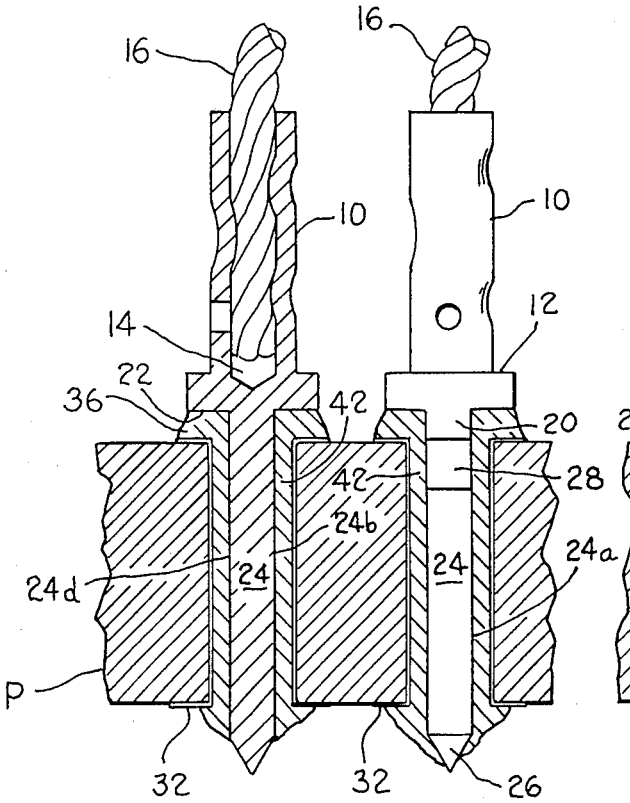
FIG. 3 is a sectional view taken along line 3—3 of FIG. 2.
Figure 4:
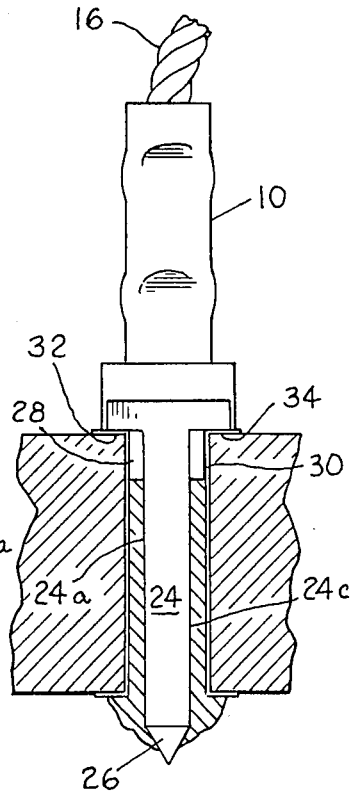
FIG. 4 is a sectional view taken along line 4—4 of FIG. 2.

Referring now to FIG. 3, it can be seen that the lateral extension of rectangular spacer 20 forms support shoulders 32 and 34 which support crimp contact A in plated-through holes 32. A solder space 36 is defined between solder contact surface 22 and the top of the plated-through hole. In the soldering process, solder completely fills space 26 against lower solder contact surface 22 of widened flange 12 for complete and reliable electrical contact.

Figure 5:
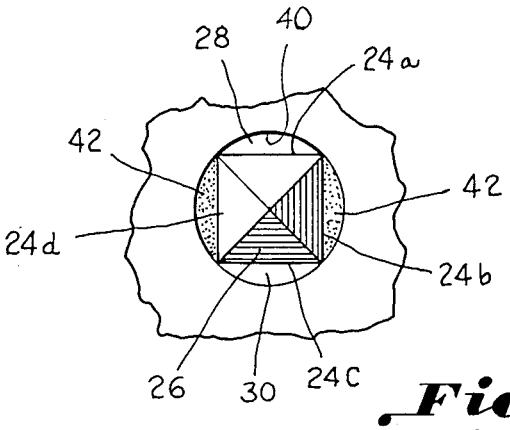
FIG. 5 is a bottom plan view of FIG. 3.

The planar surfaces **24*a* through 24*d* of square solder post 24 intersect one another at angles defining sharp longitudinal edges. The square post is dimensioned such that the square edges engage the inside of plated-through holes 32 to guide the crimp contact during insertion. Quarter round sections 28 and 30 seat the crimp contact firmly within the opening 40 of plated-through holes 32. For this purpose, the cross diameter of round sections 28 and 30 may be slightly larger than the inside diameter of the opening of plated-through holes 32. This facilitates firm holding of the crimp contacts which have been crimped onto conductor wires 16 for mass soldering such as by a conventional wave soldering process. It will be noted that quarter round sections 28 and 30 are formed on only two opposing surfaces 24*a* and 24*c* of square solder post 24. This interrupts the circular seat and leaves opposing surfaces 24*b* and 24*d* of square post 24 open for the flow of solder. As can best be seen in FIGS. 3 and 5, during the soldering process, solder flows up solder post 24 making all levels of electrical interconnect into solder space 36 against lower solder contact surface 22. The opening 42 facilitates this complete flow upwards. During the upward flow of solder, crimp contact A is held firmly in place by seating means 28 and 30**.

According to the method of the invention, electrical conductors in the form of wire strands with an outside layer of insulation are prepared by stripping the insulation from the ends of the conductors. This leaves wire strands 16 which are twisted together and inserted in crimp barrel 10. By use of a crimp tool, the wire and barrel are crimped together as can best be seen in FIG. 3. The crimp contacts for each discrete wire are then inserted into openings 40 of plated-through holes 32. Being firmly seated and retained in the plated-through holes by seating means 28 and 30, the seated crimp contacts are subjected to a solder process. A solder process such as wave soldering is utilized whereby solder flows upwardly around all four sides of square post 24 until the solder reaches round seating sections 28 and 30. Thereafter, the solder flows through openings 42 on the planar sides of square post 24 up into solder space 36 against lower solder contact surface 22 of flange 12 of crimp contact A. The solder flow thus described, creates complete and reliable electrical contact between the different levels of circuitry in multilayer printed circuit board P and crimped contact 10.

Thus it can be seen that an advantageous construction and method for a crimped contact for terminating a printed circuit board can be had in accordance with the present invention. The need for two skilled technicians for hand soldering of discrete wires to the printed circuit board is eliminated. A single technician may crimp the wires into the contact and inserting the contacts into the printed circuit board for wave soldering. The crimp contact and method allow for mass production in an automated manner with increased reliability meeting military and commercial requirements.

In repairing broken wires in the field, the solder may be reflowed and the crimp contact removed from the plated-through hole of the board. The broken wire may then be recrimped in the new contact and reinserted in the plated-through hole for resoldering. Removal of the crimp contact in the field by reflowing the solder and removing the contact eliminates the problems of wires breaking off and damage to the plated-through hole that has occurred with hand soldering and repair of discrete wires.

While a preferred embodiment of the invention has been described using specific terms, such description is for illustrative purposes only, and it is to be understood that changes and variations may be made without departing from the spirit or scope of the following claims.

What is claimed is:

1. A method for terminating electrical conductors having electrical wires surrounded with insulation of the type with multilayer printed circuit board having plated-through holes interconnecting a number of levels of electrical circuitry comprising:

providing a crimp contact having a self-seating solder post and a crimp barrel for firmly holding said electrical conductor;

stripping the insulation from said electrical conductors to expose the electrical wires;

inserting said electrical wires into the crimp barrel of said crimp contact;

crimping said electrical wires inside said crimp barrel to firmly attach and hold said electrical conductor in electrical contact with said crimp contact;

inserting said crimp contact and attached electrical conductor into said plated-through hole on one side of said printed circuit board in a manner that said crimp contact is firmly seated in said hole and said solder post extends generally through said hole; and soldering said crimp contact into said plated-through hole from the opposing side of said printed circuit board in a manner that said solder flows along the length of said hole interconnecting the levels of electrical circuitry in said printed circuit board with said electrical connector.

2. The method of claim 1 including wave soldering the entire printed circuit board with said crimp contacts inserted in a number of said plated-through holes.

3. The method of claim 1 wherein said crimp contact is inserted in said plated-through hole by pressing opposing surfaces about a periphery of said crimp contact into a generally tight fit with said plated-through hole while leaving an axial clearance between said crimp contact and said plated-through hole about the remaining periphery of said crimp contact so that solder may flow upwardly through said clearance to uniformly interconnect said crimp contact and said levels of electrical circuitry.

4. The method of claim 3 including supporting a widened flange surrounding said crimp barrel to create a space above the surface of the printed circuit board during soldering so that solder flows through said plated hole and said clearance against a bottom surface of said widened flange and solder is disposed in said space.

5. The method of claim 1 including inserting said crimp contact by press fitting opposing side surfaces of said contact in a generally tight fit with said plated-through hole.

6. The method of claim 5 including aligning said crimp contact for pressing fitting in said hole by first inserting a solder post into said plated-through hole having planar surfaces intersecting one another at angles to define sharp edges which engage said hole and align and guide said crimp contact into said hole for press fitting.

7. A crimp contact for terminating discrete, electrical conductors to a printed circuit board having plated-through holes comprising:

an elongated crimp barrel having a hollow interior for receiving and crimping an electrical conductor to hold the conductor firmly in electrical contact;

a widened flange surrounding said crimp barrel extending radially outward beyond said crimp barrel providing an enlarged solder contact surface on a lower surface thereof facing said printed circuit board when inserted in the board;

a spacer block integral with said widened flange and disposed below said widened flange for supporting said widened flange above the printed circuit board to create a solder space between said enlarged solder contact surface and said plated-through hole;

a generally square solder post extending from said solder contact surface and said spacer block terminating at a free end;

a pair of round seating sections carried by opposing planar surfaces of said square solder posts for engaging an inside diameter of said plated-through hole and firmly seating said contact within said plated-through hole in a manner that movement in a radial direction is prevented and movement in an axial direction is limited so that the contact is held firmly in the plated-through hole for soldering; and said solder post having two opposing planar surfaces which are devoid of round seating sections so that a clearance space is formed between said planar post surfaces and said plated-through hole extending from the free end of said solder post to said annular contact surface facilitating the flow of solder along generally the entire length of said solder post through said plated through hole and outwardly through said solder space for complete soldering against said enlarged solder contact surface.

8. A crimp contact for terminating a multilayer printed circuit board of the type having plated-through holes and a number of levels of electrical circuitry comprising:

an elongated crimp barrel having a hollow interior for receiving and crimping an electrical conductor to hold the conductor firmly in electrical contact;

a widened flange extending outwardly beyond said crimp barrel providing a solder contact surface on a lower surface facing said printed circuit board when inserted therein;

contact spacer means for supporting said widened flange above said printed circuit board to create a solder space between said solder contact surface and said plated-through hole;

a solder post extending from said solder contact surface and terminating at a free end;

seating means formed adjacent said spacer means for firmly seating said contact within said plated-through hole preventing movement in a radial direction and limiting movement in an axial direction so that said contact is held securely in said plated-through hole for soldering; and said seating means being interrupted about a periphery of said solder post to create a clearance between said solder post and said plated-through hole allowing passage of the flow of solder into said solder space between said solder contact surface and said plated-through hole.

9. The device of claim 8 wherein said solder post includes planar surfaces which intersect at angles to define sharp longitudinal edges for engaging an opening of said hole and aligning said post for press fitting of said seating means within said hole.

10. The device of claim 9 wherein said seating means includes a generally round section projecting radially to a fit with the opening of said plated-through hole.

11. The device of claim 9 wherein said solder post has a generally square cross section, said round section projecting radially on two opposing surfaces of said square post, and the remaining surfaces of said square post being continuously planar from said free end to said solder contact surface defining said clearance and facilitating solder flow through said plated-through hole and interconnecting of said levels of electrical circuitry and said crimp contact.

12. The device of claim 9 wherein each said round section consists of a quarter round.

* * * * *